United States Patent [19]

Niemann

[11] 4,030,795

[45] June 21, 1977

[54] LOCKING DEVICE FOR ELECTRICAL PLUGS

[76] Inventor: John A. Niemann, 2056 Wilshire Drive SE., Grand Rapids, Mich. 49506

[22] Filed: Mar. 5, 1976

[21] Appl. No.: 664,197

[52] U.S. Cl. ..... 339/37

[51] Int. Cl.[2] ..... H01R 13/44

[58] Field of Search ..... 339/36–38, 339/39, 82, 91 R, 75 P; 70/57

[56] References Cited

UNITED STATES PATENTS

| | | | |
|---|---|---|---|
| 2,664,734 | 1/1954 | McEneaney | 339/37 |
| 2,732,531 | 1/1956 | Janowiec | 339/91 R |
| 3,179,738 | 4/1965 | DeLyon | 339/91 R |
| 3,543,544 | 12/1970 | Efston | 339/37 |

*Primary Examiner*—Roy Lake
*Assistant Examiner*—Neil Abrams
*Attorney, Agent, or Firm*—Dale Austin Winnie

[57] ABSTRACT

A locking device for male electrical plugs and which includes a body member with slots receptive of the contact making terminals of the electrical plug, first means in the body member projecting into the slots to engage and hold the body member to the contact terminals, and a second means insertable into the slots to hold the first means retracted and allow disassociation of the electrical plug from the body member.

6 Claims, 14 Drawing Figures

LOCKING DEVICE FOR ELECTRICAL PLUGS

BACKGROUND OF THE INVENTION

There is a need for some means or method to prevent young children and other unauthorized persons from using electrically operated devices, and particularly power tools, which might cause injury or harm to them and/or damage to the electrical appliance involved.

In the home there are power tools in the basement workshop, power operated garden tools out in the garage, electric knives and mixers in the kitchen, hair dryers and curlers in the bathrooms, all of which are potentially dangerous to young children and even older children who haven't been taught how to use them.

In offices and shops there are certain electrically operated devices that are best left to experienced and trained personnel. In retail appliance stores, only demonstrator models should be operable without a sales person in attendance. And, certain sophisticated electronics devices are tagged with warnings that they should not be plugged in after delivery until they have first been properly serviced and set-up.

Obviously, it is not practical to have built in key locking devices in all such appliances, nor is it practical to expect that any of the commonly known key or combination locks will be used in either storing away such equipment or in preventing their use, as by some lock box on the plug-in end of their electrical cords.

There are plug-in and rotatable closures for use in the electrical wall outlets in rooms where small children play and might stick something into a wall socket, but it is not practical to have these all over the house and many of the items mentioned are portable and can be carried to a socket that is not so protected. Such devices are also overly simple and easily operable by children, once they see how it is done, and would be no discouragement whatsoever in those instances involving inquisitive adults who "just have to try" whatever it is they are curious about and find unattended.

From a consideration of the forgoing, what appears to be needed in some relatively simple device, which can be inexpensively made, and that will fit over the end of the electrical cord, and enclose the plug, or otherwise make it inoperative. Also, that such a device require both some dexterity, to foil the efforts of younger children, and if possible some sort of key device, of a simple nature, to discourage all others that might otherwise be tempted to tamper with the protected tool, appliance or whatever it may be.

SUMMARY OF THE PRESENT INVENTION

This invention relates to a locking device for use on the end of an electrical cord, in combination with the male plug, to prevent unauthorized use of the electrical tool or appliance associated therewith.

The locking device includes a body member about the size of the male plug with which it is to be used and with two slots provided in it which are receptive of terminals extending out of the electrical plug. Means are provided in the body member for fastening it securely to the contact making terminals when they are inserted therewithin, and separate means are provided, which are insertable in the slots from the other side, to enable the plug to be subsequently separated from the locking device, when and as desired.

The body member, in a simplified and preferred form, is a one piece molded plastic piece, of a resilient material, formed to include locking fingers that extend within the terminal receptive slots for latching engagement in the holes commonly provided in the plug's contact making members. The locking fingers yield as the contact members first engage them and then snap into the holes as they come into alignment with them.

This latch or locking engagement is made to occur with the contact members only partially received in the body member and so that further insertion, moving the holes past the locking fingers, will cause the fingers to yield and their latching ends to be retracted sufficiently for a staple like key means, of a little less width than the slots in the body member, to be inserted in the slots to hold the fingers in their retracted position and allow the contact members with the electrical plug to be disassociated from the locking device.

In the absence of the staple like key, any attempt to separate the body member from the electrical plug will merely cause the locking fingers to snap back into the holes in the contact making members and prevent their disassociation.

DESCRIPTION OF THE DRAWING FIGURES

DETAILED DESCRIPTION OF ILLUSTRATED EMBODIMENT

Figure 1:
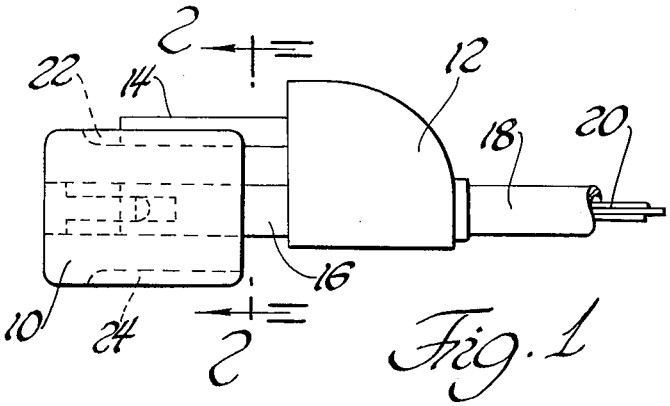
FIG. 1 is a side plan view of a locking device embodying the teachings of the present invention as applied to the male plug on an electrical cord.
Figure 2:
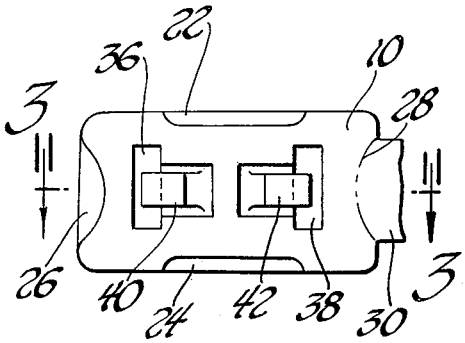
FIG. 2 is a top plan view of the locking device as would be seen in the plane of line 2—2 in the preceeding drawing figure, with the male plug removed.

In the preferred form of the present invention, the locking device proposed for use on the plug end of an electrical cord is in the form of a relatively small molded plastic body member 10, which is rectangular in shape and a little deeper than it is wide.

It is intended for use with any male electrical plug having the conventionally known pair of parallel spaced contact making terminals or prongs and is shown in locked association with such a plug 12 in the first drawing figure. This particular electrical plug happens to be of the grounded type with a third ground making terminal 14 but will otherwise be appreciated as including the normal contact making terminal members 16 and having an electrical cord 18 through which conductor cables 20 pass for connection to respective contact making elements within the plug head.

The body member 10 will be noted as formed to include concave outer side walls 22 and 24, which extend to the plug receptive end thereof. These serve to accomodate the grounding terminal 14, when it is present, and otherwise to facilitate easier handling. Similar concavities 26, 28 are formed on the ends of the body member, to also facilitate easier handling, and a fastening strap 30 is formed to extend off a lower side end of the body member, with the generally known toothed end 32 and receptive slot 34, for use in attaching the body member somewhere on the electrical cord 18, when it is not in use.

Figure 3:
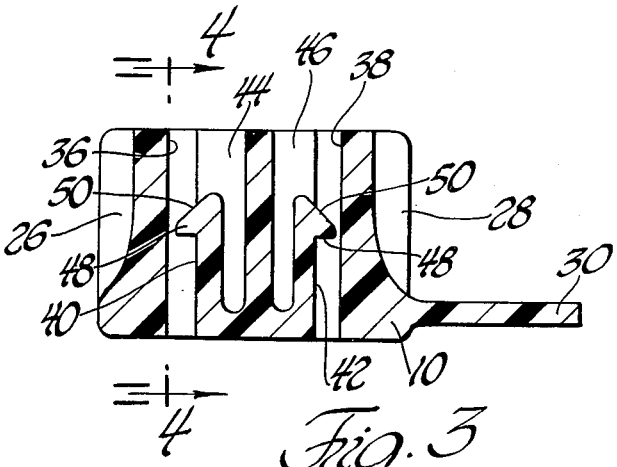
FIG. 3 is a cross-sectional view of the locking device as seen in the plane of line 3—3 in the immediately preceeding drawing figure.
Figure 4:
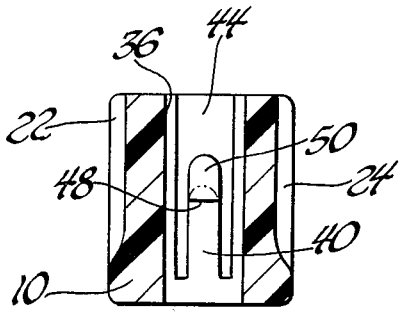
FIG. 4 is a cross-sectional view of the locking device as seen in the plane of line 4—4 in figure 3 and looking in the direction of the arrows.
Figure 5:
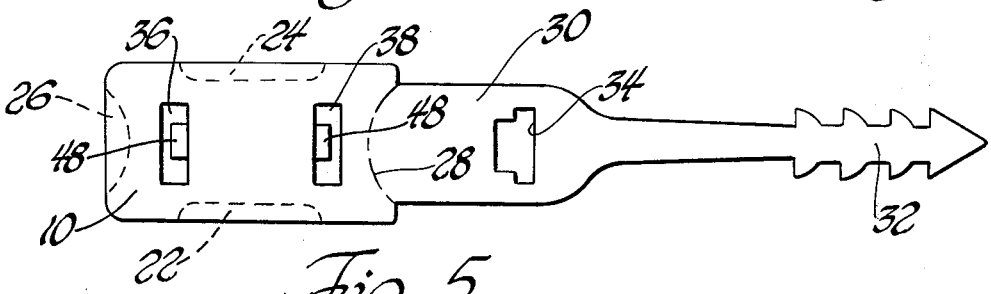
FIG. 5 is a bottom plan view of the locking device.

Referring now to the details of construction within the locking device, as best seen in FIGS. 3 and 4 a pair of slots 36 and 38 are formed clear through the body member, from one end to the other, to receive the contact making terminal members 16 of an electrical plug.

Latching members 40 and 42 are formed within the body member to extend inwardly from one end within suitably recessed spaces 44 and 46 which are provided for such purpose and are in open communication with the two slots.

Each latching member is like a finger extending into the body member and is provided with a crook 48 at its end that extends into the slot beside it. And each latching member is also formed with an inclined surface 50 on the outer disposed side of its head end.

Because of the dimensioning of the finger like latching members, and the plastic material of which they and the whole body member are made, it will be appreciated that the latching fingers are relatively flexible. As a consequence, each latching finger will yield inwardly upon initial engagement with the contact members 16 of an electrical plug being inserted into the receptive slots 36 and 38.

Figure 11:
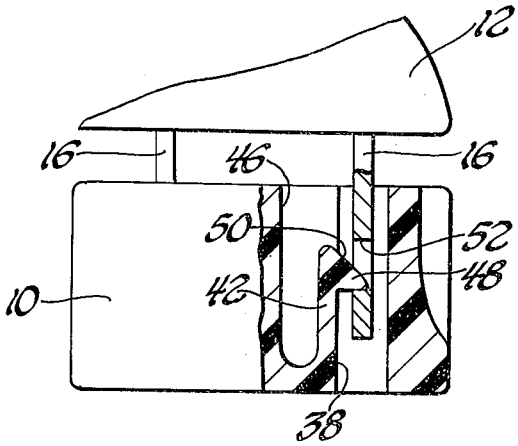
FIG. 11 is a first sequential view of an electrical plug partially inserted into a locking device, with parts broken away and shown in cross-section.
Figure 12:
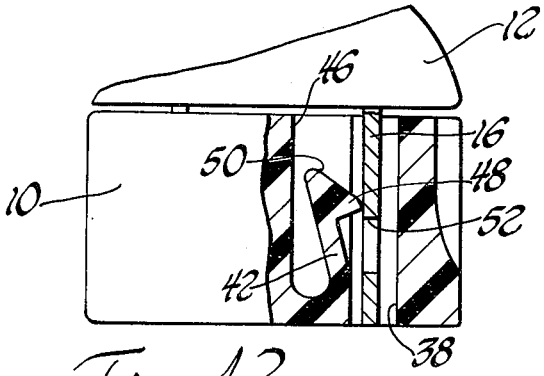
FIG. 12 is a second sequential view similar to FIG. 12 with the male plug shown inserted further into the locking device.

Referring now to FIG. 11, it will be noted that following the initial engagement and retraction of the latching fingers 40, 42 they resume their first and normal position as the holes 52, which are commonly provided in male contact terminals, come into alignment with their crooked ends 48. Further movement of the contact terminals 16 into the receptive body slots, as shown in FIG. 12, will cause the latching finger members to again be retracted. But the fingers will become re-engaged with the contact members upon any effort that is made to withdraw them, as the holes in the contact members become re-aligned with their latching ends, and will prevent any further disassociation of one member from the other.

Figure 6:
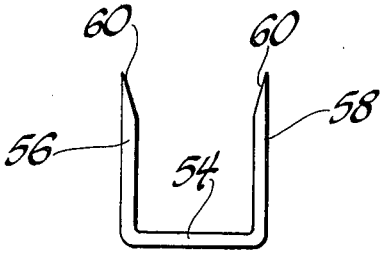
FIGS. 6 and 7 show the key member in side elevation and perspective views, respectfully.
Figure 7:
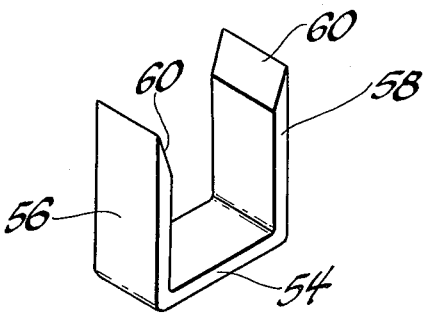

The means which is used to enable the locking device to be separated from the end of an electrical plug is shown in FIGS. 6 and 7.

Figure 13:
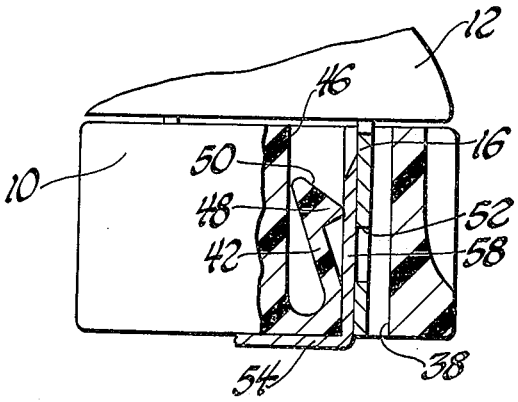
FIG. 13 is a third sequential view, similar to FIGS. 12 and 13, with the key means for removing the locking device from the electrical plug shown in place.

Essentially it is a staple like member 54 of a little less width than the two contact terminal slots 36, 38 and with legs 56, 58 of sufficient length to project up into the body member to a relative heighth where they will extend beyond the crooked end 48 of the latching fingers and hold the latching fingers in a retracted position, as shown in FIG. 13.

The spacing between the two legs of the staple of "key" member 54, is such as will dispose each leg closely next adjacent to the inner side wall of each of the slots 36, 38. The end of each leg is also chamfered or brought to a sharper point, as at 60, at its outer side edge.

Should the key member 54 be used when the body member 10 and the electrical plug 12 are engaged as shown in FIG. 11, it will be unable to push the crooked end 48 of the latching finger back into a retracted position. Instead, it would be stopped short and could not be inserted further.

However, with body member 10 and electrical plug disposed tighter together, as in FIG. 12, it will be noted that the crooked end of the latching finger is already withdrawn from the latching hole 52 in the contact member. It is also inclined slightly and sufficiently for the sharpened end of the key member to pass between the crooked end of the latching finger and the contact member to hold the latter retracted and allow the electrical plug to be separated from the locking device.

Figure 8:
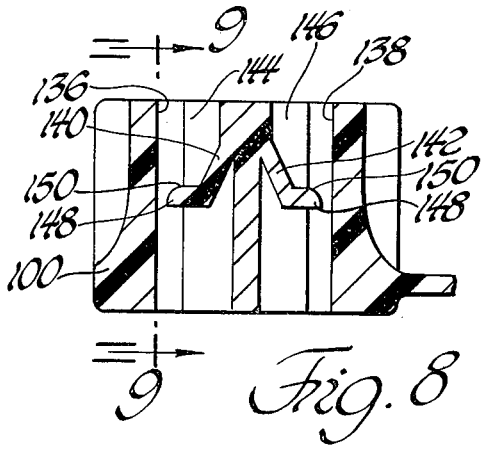
FIG. 8 is a cross-sectional view of another form of locking device.
Figure 9:
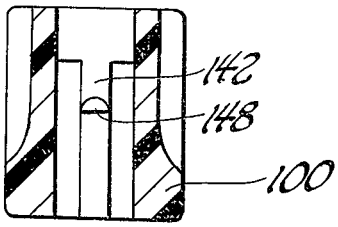
FIG. 9 is a cross-sectional view of the locking device shown in FIG. 8 as seen in the plane of line 9—9 therein and looking in the direction of the arrows.
Figure 10:
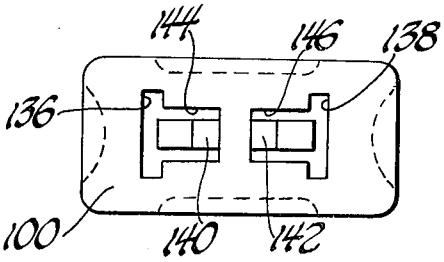
FIG. 10 is a bottom plan view of the locking device of FIGS. 9 and 10.

FIGS. 8–10 show another form or modification of the locking device that has just been described.

The body member 100 is of a like material and external shape and form as the body member 10, and includes similar slots 136, 138 and adjoining spaces 144, 146. However, in this embodiment the latching finger members 140, 142 extend inwardly down and out from the same end as the electrical plug is engaged to, rather than up and out from the opposite end, as in the embodiment first described.

The latching fingers are formed to include latching ends 148, that extend into the slots and have surfaces 150 on their back side to facilitate their retraction to within the recess space behind them, similar to the other embodiment, when engagement is first made with them.

Figure 14:
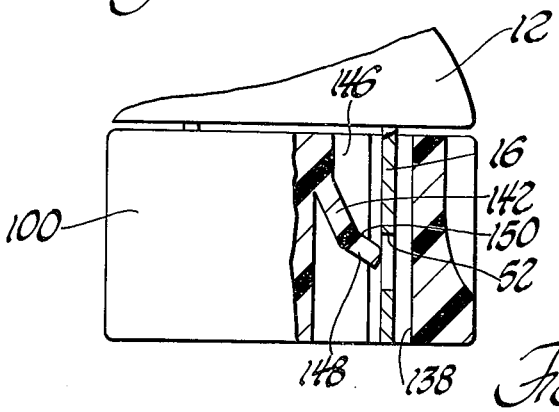
FIG. 14 is similar to the preceeding drawing figure but is of the locking device shown in FIGS. 8—10 and without the key means shown inserted therewithin.

The principal difference between the two locking devices lies in the fact that once the latching engagement is obtained, with the finger ends in the holes in the contact making terminal members, efforts to pull the electrical plug and the body member 100 apart will cause the latching means of the second embodiment to be spread further apart. And, where the key staple member is used while the finger ends are similarly engaged, the same thing will occur. Only when the electrical plug and body member 100 are disposed closely together, as shown in FIG. 14, will the finger ends be sufficiently removed from the holes and rotated enough for the legs of the staple key member to be pushed past them to hold them retracted, similar to what is shown in FIG. 13, while the electrical plug is withdrawn.

In both of the embodiments shown and described, a simple one piece molded plastic body member is provided with a pair of slots into which the contact making terminals of a male electrical plug are inserted. The latching means provided within each body member yields and then snaps into locking engagement with the contact making terminals as the holes in the contact members become aligned with the outwardly projecting ends of the latching means.

After the electrical plug has been fully inserted into the locking device, or the locking device has been inserted on and bottomed against the electrical plug, the two should be pulled apart to check and obtain a fully locked association. Failure to do so is of no consequence, however, since any subsequent effort to separate the two will cause this to occur anyway.

Subsequently, to separate the locking device from an electrical plug that it is fastened to, the two are pushed tightly together, which causes the latching means to be partially retracted, and the key staple member is inserted into the slots, from the bottom end of the locking device, to hold the latching means in their retracted position and allow the electrical plug and locking device to be pulled apart.

The advantage in normally leaving the locking device in fully locked association with an electrical plug, which occurs when the two are partially separated after being pushed together, is that the key means is not operative by someone who holds the locking device and trys to use the key means to get them apart.

The key means is purposely simple and inexpensive, even to the extent of being capable of being made in a home workshop, so that extras can be readily available, in a desk drawer or high on a shelf, out of the way and unnoticable.

The small amount of dexterity required is sufficient to thwart most young children, even if the key means is available, and without the key means the locking device is essentially inoperative even by adults.

I claim:

1. A locking device for use with electrical plugs having extended terminals with holes provided in the ends thereof, and comprising; a body member having slots provided therein and which are receptive of the entended terminals of an electrical plug, a first means provided within said body member and biased to extend within said slots for latching engagement with said terminals upon the alignment of the holes in the ends of said terminals therewith, and a second means for holding said first means in a retracted disposition and allowing for the disassociation of said terminals from said body member, said second means being separate and apart from said body member and formed for insertion in said slots and to extend relatively between said terminals and said first means.

2. The locking device of claim 1, said first means being formed and disposed for latching engagement with said terminals as only partially inserted within said slots and for retracted engagement therewith as fully inserted within said slots.

3. The locking device of claim 2, said first means being biased for relatching engagement with said terminals upon movement thereof from a fully inserted to a partially inserted disposition within said slots.

4. The locking device of claim 3, said first means being formed integrally with said body member and to include latching members disposed closely next adjacent said slots and which extend into said body member from one end thereof and project laterally into said slots relatively between the ends thereof.

5. The locking device of claim 4, and latching members being provided with said body member between said slots.

6. The locking device of claim 5, said second means including a U-shaped member separately associated and disassociated with said body member and having the legs thereof relatively sized and spaced for close fitted insertion within said slots between said terminals and said latching members from the end opposite that which is receptive of said terminals.

* * * * *